United States Patent [19]

Lingl, Sr. et al.

[11] 4,308,772

[45] Jan. 5, 1982

[54] PROCEDURE AND DEVICE FOR CUTTING BRICK BLANKS FROM CLAY COLUMNS

[75] Inventors: Hans Lingl, Sr.; Hans Lingl, Jr., both of Neu-Ulm-Ludwigsfeld, Fed. Rep. of Germany

[73] Assignee: Lingl Corporation, Paris, Tenn.

[21] Appl. No.: 138,598

[22] Filed: Apr. 9, 1980

Related U.S. Application Data

[63] Continuation of Ser. No. 942,034, Sep. 13, 1978.

[51] Int. Cl.[3] ..... B26D 7/06

[52] U.S. Cl. ..... 83/23; 83/56; 83/155.1

[58] Field of Search ..... 83/651.1, 155, 155.1, 83/424, 426, 427, 433, 435.2, 56, 307.1, 23

[56] References Cited

U.S. PATENT DOCUMENTS

| | | | |
|---|---|---|---|
| 589,892 | 9/1897 | Gord | 83/307.1 |
| 1,275,775 | 8/1918 | Simmonds . | |
| 2,099,119 | 11/1937 | King | 107/20 |
| 3,461,196 | 8/1969 | Bowles | 264/148 |
| 3,492,703 | 2/1970 | Bergling | 25/112 |
| 3,602,963 | 9/1971 | Lingl | 25/105 |
| 3,805,655 | 4/1974 | Urijma | 83/425.3 |
| 3,838,621 | 10/1974 | Keck | 83/401 |
| 3,976,417 | 8/1976 | Lingl | 425/307 |
| 4,085,635 | 4/1978 | Lingl | 83/13 |

FOREIGN PATENT DOCUMENTS

| | | |
|---|---|---|
| 272174 | of 0000 | Austria . |
| 1683849 | of 0000 | Fed. Rep. of Germany . |
| 567724 | 5/1931 | Fed. Rep. of Germany . |
| 2453934 | 5/1976 | Fed. Rep. of Germany . |
| 1525488 | of 0000 | France . |
| 1176245 | 1/1970 | United Kingdom . |
| 1305594 | 2/1973 | United Kingdom . |

*Primary Examiner*—Harold D. Whitehead
*Attorney, Agent, or Firm*—Cushman, Darby & Cushman

[57] ABSTRACT

The invention relates to a method and apparatus for efficiently cutting clay columns. The apparatus employs at least two supporting conveyors with one positioned downstream from the other and spaced apart a predetermined distance defining a gap therebetween. Each conveyor is wide enough to handle any desired column length so that no changes thereof are necessary when the size of the cut length changes. The conveyors or the end rollers thereof adjacent the gap are arranged to move horizontally thereby causing the gap to move. The cutting mechanism moves vertically and is operated in a coordinated fashion with movement of the gap following the point of intersection of at least one cutting wire with the conveyor plane so that clay columns are conveyed and cut simultaneously. Material adhering to the cutting wire(s) is automatically cleaned therefrom during cutting.

23 Claims, 8 Drawing Figures

PROCEDURE AND DEVICE FOR CUTTING BRICK BLANKS FROM CLAY COLUMNS

This is a continuation of application Ser. No. 942,034, filed Sept. 13, 1978.

BACKGROUND AND SUMMARY OF THE INVENTION

The invention is concerned with a procedure for cutting brick blanks from an extruded strand of green brick material known as clay columns. The invention is also concerned with apparatus for carrying out that procedure.

It is known that individual brick blanks can be cut from a clay column by pushing that column at right angles to the direction the column is moving through a cutting frame employing tightened wires. This is shown in U.S. Pat. Nos. 3,461,196 and 3,602,963.

Such devices are chiefly used in the outer wall industry, where columns are pressed or squeezed very hard, for example, in order to produce certain surface structures or designs on the bricks.

The disadvantage of these devices is the fact that, in cases where a firm pressing is not possible or desirable because of the characteristics of the raw material or because of the construction of the column for example, for the production of hollow bricks, a push-through cutter cannot be used since the pushing element would deform the column or leave strong markings on the head ends of the bricks. Further, these wires can leave ragged and sharp edges on the bricks which can subsequently injure individuals handling the bricks.

Cutting clay columns with a cutting device by means of a cutting frame, supported so that it can rotate, in which cutting wires are located at intervals from each other is also known. The column is conveyed on a transportation device comprised of a number of narrow conveyor belts located close to each other, and the cutting wires sink into holes or spaces defined between the belts after every cut.

The disadvantage of this apparatus, which now, in fact, can divide hard or soft clay columns consists in the fact that a separate belt table or assembly line must be available for each cut length so that changing cutting lengths is a very time-consuming and expensive operation. Another disadvantage of this device is the fact that the clay columns are not completely supported during cutting, so that the lower edges of bricks can be deformed when being cut. Further, the wires can only be cleaned after every cut by a relatively time-and-energy-consuming device, and since the cleaning device has to be moved along the wires while they are held in a stationary position an additional time delay factor is created.

Furthermore, cutters for cutting brick blanks from clay columns using cutting frames with a large number of cutting wires, is also known, with the wires operating through holes or spaces between conveyor belts installed close to each other or in sheet metal supports, or by sinking into them.

These devices also have the disadvantages described above, for example, that individual assembly lines are required for each cut length, and they have to be switched each time the cut length is changed.

In contrast, the basic task of the present invention is to cut brick blanks from clay columns in a simple manner and with great efficiency, by having the clay column lie on a continuously wide conveyor device during cutting with the width being at least as wide as the longest clay column. Accordingly, the conveyors do not have to be switched when the cut length changes.

In contrast with the familiar devices described above, the present invention has significant advantages in that no slide is used for cutting the brick blanks which would otherwise press the column through the wires of the cutting frame. Further, the wires do not sink into holes between conveyor belts located next to each other, so that no assembly lines, tables or other supports have to be switched when changing cutting lengths. Also, the wires can be cleaned by a simple device during cutting.

Accordingly, it is the primary object of the present invention to provide not only a high capacity cutting method and device, but a highly efficient one as well which produces high quality bricks. These and other objects will become apparent from an inspection of the detailed description together with the following schematic diagrams.

Exemplary apparatus according to the present invention and for practicing the method of the present invention is generally shown in the above Figures. Further, the apparatus is for cutting clay columns or the like into individual bricks.

Figure 2:
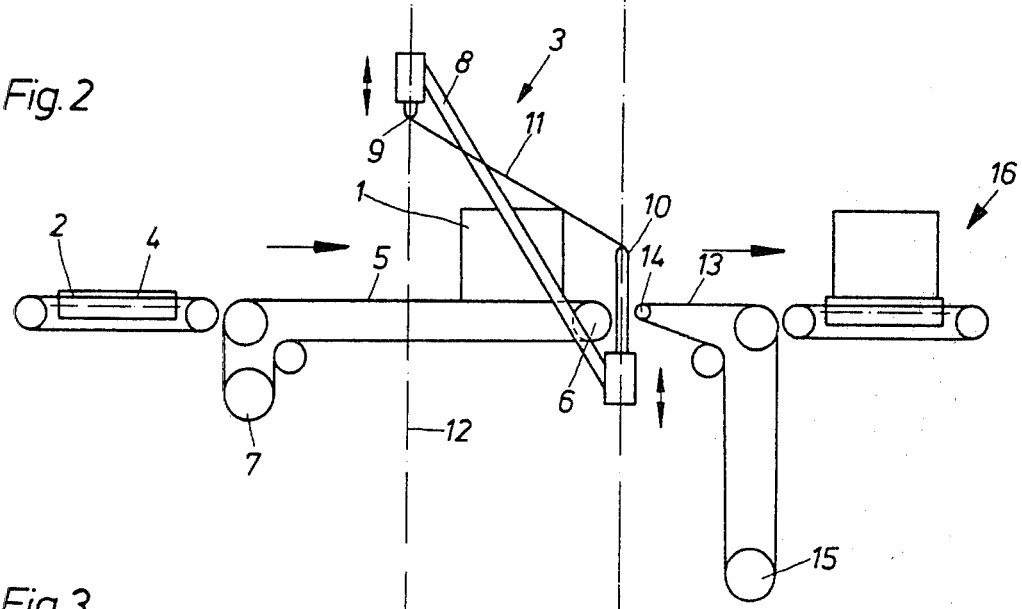
FIG. 2 diagrammatically shows a side elevation of one embodiment of the present invention just prior to beginning the cutting operation.

A predetermined length of clay is cut from an extruded length of clay and the cut piece 1, referred to as a clay column, is conveyed on a conveyor belt 2 to the area of the cutting device, generally indicated at 3 in FIG. 2. Here, clay column 1 is turned over to another set of conveyor belts 4 for transverse conveyance by the dropping of the conveyor belt 2, which consists of rollers supported between the belts comprising conveyor belt 4.

Figure 1:
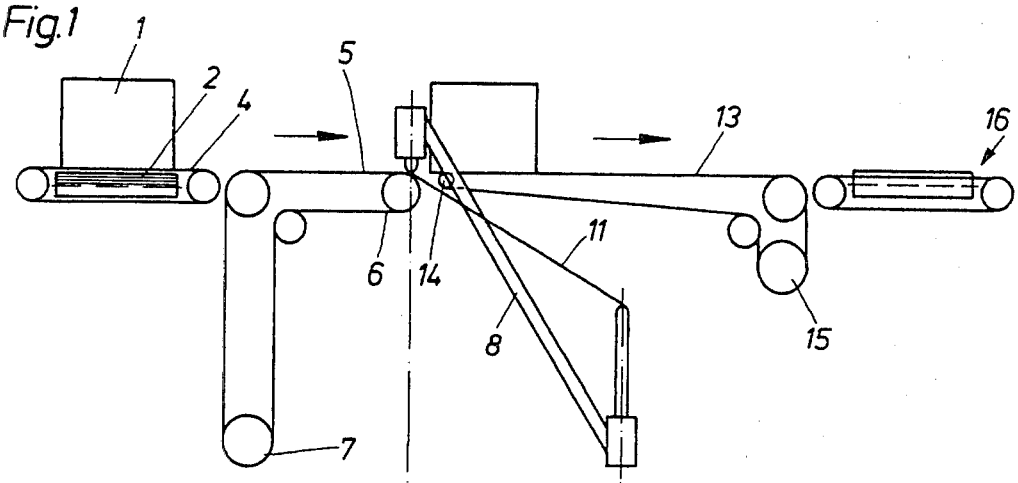
FIG. 1 diagrammatically shows a side elevation of one embodiment of the present invention where the cutting operation has been completed.
Figure 3:
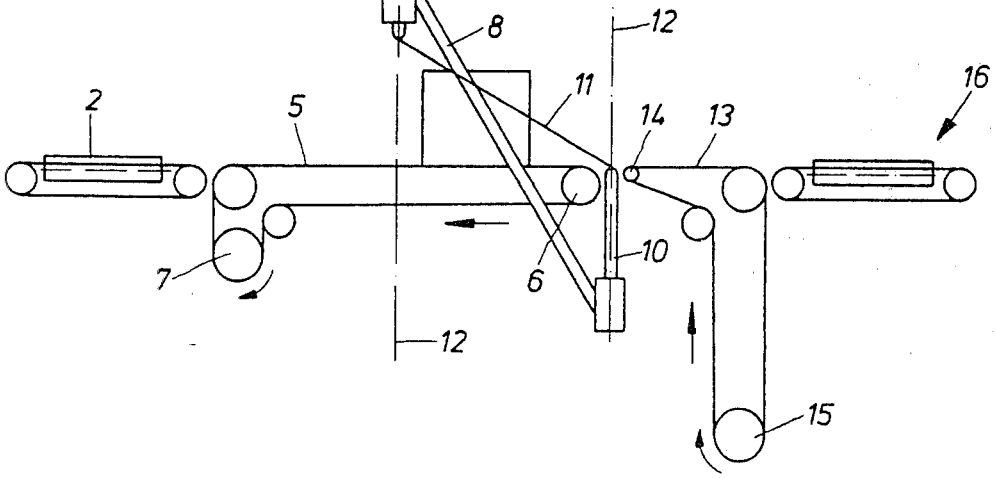
FIG. 3 diagrammatically shows a side elevation of one embodiment of the present invention during the cutting operation.
Figure 4:
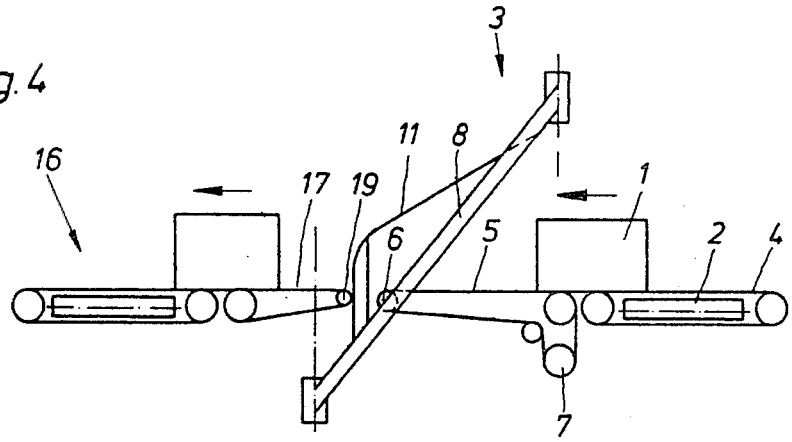
FIG. 4 diagrammatically shows a side elevation of another embodiment according to the present invention between cutting operations.
Figure 5:
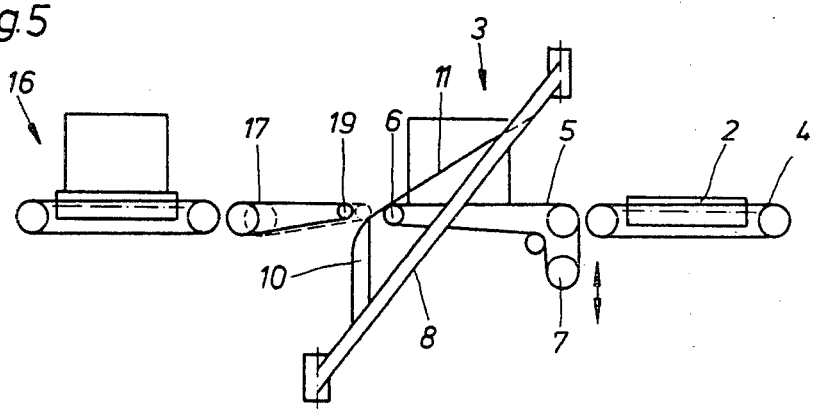
FIG. 5 diagrammatically shows a side elevation of the embodiment shown in FIG. 4 during the cutting operation.
Figure 6:
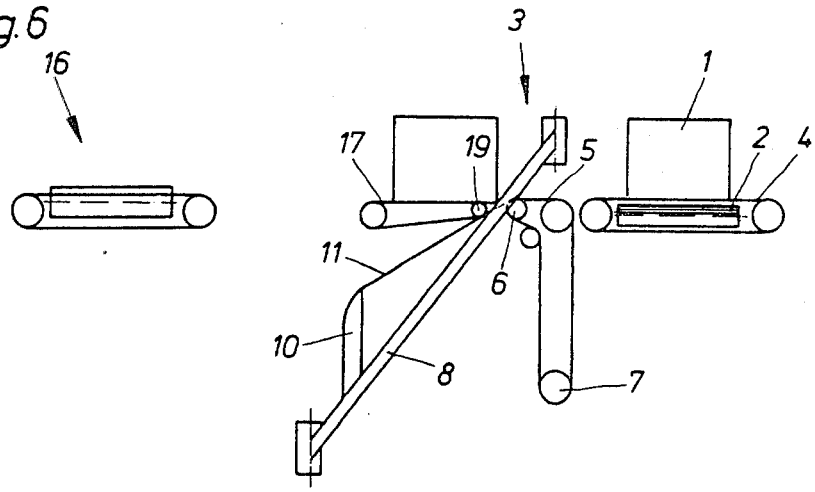
FIG. 6 diagrammatically shows a side elevation of the embodiment shown in FIG. 4 where the cutting operation has just been completed.

After clay column 1 is turned over to conveyor belts 4, that conveyor is actuated and serves to convey clay column 1 onto a broad conveyor belt 5 corresponding to the length of the clay column. Conveyor belt 5 extends around a nondriven end roller 6 designed to move in a horizontal plane away from and toward the conveyor's intake area and a fixed roller so that the bearing or supporting surface of conveyor belt 5 can be lengthened or shortened as desired such as when the cutting apparatus described more fully hereinafter, is raised or lowered and the belt is unrolled when the belt drive is at a standstill. An idler or tension roller 7 serves to adjust tension in conveyor belt 5 as end roller 6 is moved to vary the length of the supporting surface of conveyor belt 5. When clay column 1 is in the cutting position, with the end roller 6 being at the greatest distance from the intake, and the cutting clamp 8 of the cutting device 3 is in the uppermost position as shown in FIGS. 2 and 4, the cutting clamp 8 is moved downward along the guide axes 12. Attached to cutting clamp 8 are upper binding posts 9 and lower binding posts 10 between which a predetermined number of cutting wires 11 are stretched at desired cutting intervals. Until wires 11 sink into the conveyor plane, the distance between end roller 6 and the intake point of conveyor belt 5 is unchanged. After wires 11 sink into the conveyor plane, the end roller 6, following the point of intersection of the wires 11 with the plane defined by the conveyor's surface, is displaced so that the conveyor belt 5 unrolls from under the clay column 1, while the wires 11 simultaneously cut clay column 1 with the cut blanks thereafter being turned over to a following conveyor belt 13 (FIGS. 1–3) or conveyor belt 17 (FIGS. 4–6) which is moved beneath the cut column during cutting.

As is the case with the conveyor belt 5, a horizontally movable end roller 14 and an idler 15 form part of conveyor belt 13. End rollers 6 and 14 of conveyor belts 5 and 13 are inserted into a common carrier structure (not shown) but which can be similar to the carrier structure shown in FIG. 7, in such a way that they work jointly or move together. As indicated above, conveyor belt 13 is unrolled beneath the clay column 1 during cutting, with end rollers 6 and 14 being located at such a distance from each other that a gap occurs in the width of the cutting table. The cutting apparatus and in particular binding posts 10 and wires 11 operate within this gap and the wires 11 are clamped and positioned at an acute angle with respect to the plane defined by the conveyor surfaces.

Conveyor belt 13 has the same width as conveyor belt 5 and after the cut blanks are turned over to conveyor belt 13, which was not driven during cutting, the cut blanks are conveyed in the direction of the transportation device 16 which direction can be called the conveyance or machine direction. Conveyor 16 leads on from there and can be reversed like the conveyor belts 2 and 4.

In another embodiment, not shown, wires 11 can be lengthened so that binding posts 10 do not have to emerge either above the conveyor plane or through the gap between conveyor belts 5 and 13. In this instance, it is possible not only to unroll conveyor belts 5 and 13 from under clay column 1 during cutting in order to obtain an essentially vertical cutting action, which has only one horizontal component produced by the sloping position of the wires 11, but it is also possible, for example, to drive conveyor belts 5 and 13 during cutting, at a slower speed than when running in and running out. Accordingly, during cutting, the clay column 1 is conveyed in the direction of the conveyor device 16 (the machine direction) and the cutting action obtains a larger horizontal component.

Figure 7:
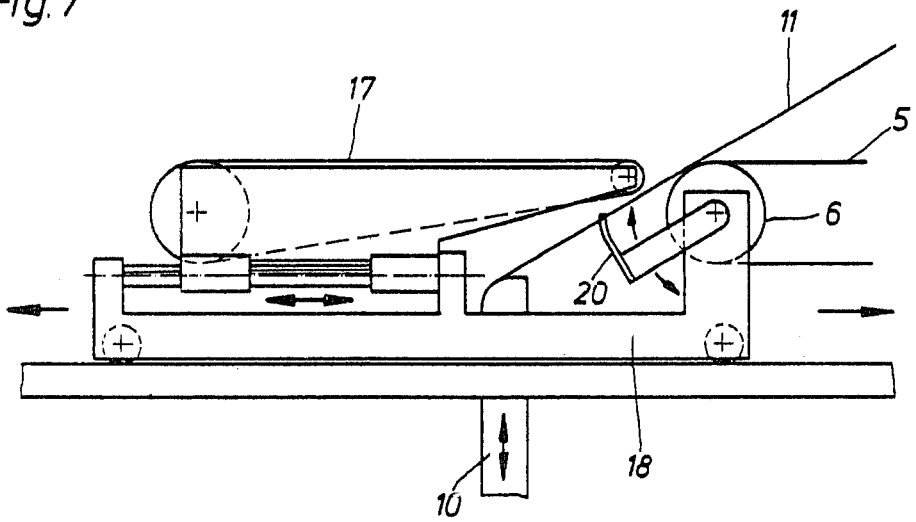
FIG. 7 diagrammatically shows a partial side elevation of the roller carrier and the cutting wire cleaner.

Turning now to FIGS. 4–7, the second or downstream conveyor belt 17 has a fixed distance between the axes of its supporting rollers with that distance normally being large enough to assure that the longest size to be cut can be completely supported. As shown in FIG. 7, conveyor belt 17 is transported horizontally on a carrier 18 jointly with end roller 6 of conveyor belt 5, with movement thereof being provided by any of a number of conventional devices, and thus follows the point of intersection of wires 11 with the conveyor plane. Further, conveyor belt 17 is driven during the cutting in such a way that the speed of movement of the carrier 18 contrary to the direction of conveyance is neutralized by the speed of the conveyor belt 17, so that the clay column does not move in a direction opposite to the machine direction.

The conveyor belt 17 is mounted movably on the carrier 18 so that, when the binding posts 19 sink into the gap between end roller 6 and conveyor belt 17, a larger distance between the end rollers 6 and 14 of the conveyor belts 15 and 17 can be produced which is sufficient to allow passage of the binding posts 10 therethrough, and which is reduced when the wires 11 sink into the gap.

After the cut is completed, the drive of the conveyor belt 17 is stopped. With the upward movement of the cutting clamp 8, the conveyor belt 17, together with the end roller 6 of the conveyor belt 5, is moved in the direction of conveyance, so that the connection with the conveyor device 16 is made to define in the output position so the cut blanks can be transported on by that latter conveyor.

Figure 8:
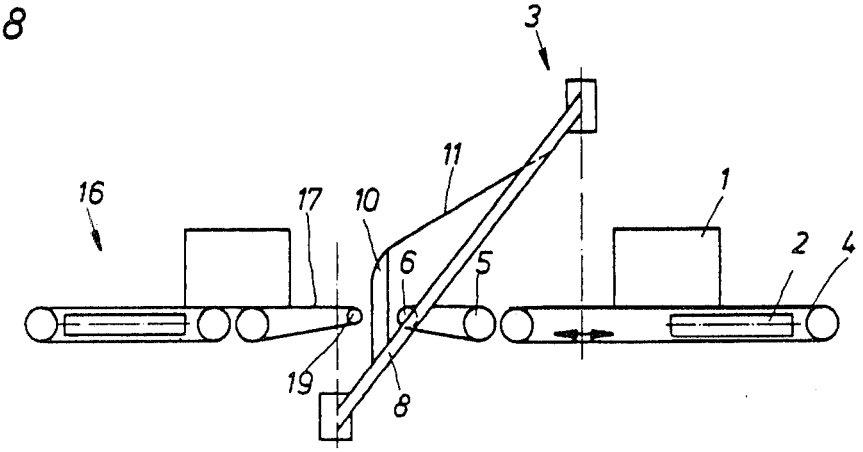
FIG. 8 diagrammatically shows yet another embodiment of the present invention.

The embodiment set forth in FIG. 8 shows a conveyor belt 4 having an extended distance between the axes of its supporting rollers. Also, conveyor belt 5, like conveyor belt 17, also now has a fixed distance between axes of its supporting rollers.

Conveyor belts 4, 5 and 17 are located in a joint carrier in such a way that the gap between end rollers 6 and 19 of conveyor belts 5 and 17 respectively, can be displaced, following the point of intersection of the wires 11 with the conveyor plane, while the conveyor belt 2 stays in engagement with conveyor belt 4 in all positions of the carrier. Conveyor belt 5, like the conveyor belt 17, is driven in such a way during cutting that the speed of movement of the carrier contrary to the direction of conveyance is neutralized by the speed of conveyor belt 5, so that the clay column 1 does not move in an opposite direction.

Turning once again to FIG. 7, a wire cleaner 20 constructed as a wiper strip is located, so that it can revolve, on end roller 6 in such a way that it can be brought into contact with wires 11 when they sink into or below the conveyor plane. In that way wires 11 are cleaned without further effort by the working of the end roller 6 at a distance from the wires 11 that remains the same.

It should be understood that there are a variety of conventional ways the cutting assembly and the various conveyors can be driven. Accordingly, it is submitted that any further explanation or detailed description thereof is not essential for a full and complete description and an understanding of the present invention.

While the invention has been described in connection with what is presently conceived to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures and methods.

What we claim is:

1. A process for cutting an elongated clay column into plural shorter sections, said process comprising the steps of:

supporting said clay column on a support device provided with an opening extending thereacross, causing relative movement between the column and the support device so that said opening is moved relative to and beneath the clay column while positioned on the support device, and simultaneously and synchronously moving a plurality of transversely spaced cutter wires in a single pass through said opening so that said cutter wires engage and pass through the supported column.

2. A process as in claim 1 further comprising the step of simultaneously cleaning said cutter wires as they are being moved through said opening.

3. A process for cutting clay columns comprising the steps of:

sequentially feeding and supporting clay columns on a support device provided with an opening extending thereacross, causing relative movement between the column and the support device so that the opening is moved relative to and beneath the clay column, and simultaneously and synchronously moving a cutter in a single pass through the opening so that the cutter engages and passes through the column.

4. A process for moving clay columns from one support assembly to another across an opening provided therebetween and for simultaneously cutting the column, as it moves, with a cutter movable between at least first and second positions within the opening comprising the steps of:

sequentially feeding clay columns onto a support assembly and positioning a cutter in a first position within the openining; and effecting relative movement between the support assembly and the column so as to move the opening beneath the column and supporting the portion of the column past which the opening has moved by another support assembly while simultaneously moving the cutter within the opening from its first position to a second position so that as the column moves and the cutter moves between its first and second positions the cutter engages and passes through the column.

5. A method of cutting brick blanks from clay columns while on a conveying system including two spaced apart supports with a movable cutting device positioned at an angle to the plane defined by the surface of the supports comprising the steps of:

sequentially transporting clay columns onto a first support positioned a predetermined distance from a downstream second support, and moving the cutting device between the first and second supports at an angle to the support surface while simultaneously transferring the clay column from the first to the second support across the space therebetween so that the cutting device engages and continuously moves through and cuts the clay column into brick blanks.

6. A method of cutting brick blanks from clay columns having a predetermined length while on a conveying system with a vertically movable cutting device positioned at an acute angle with respect to the plane defined by the surface of the conveying system comprising the steps of:

transporting clay columns sequentially onto the front portion of a first conveyor having a variable length supporting surface which is positioned a predetermined distance from a downstream second conveyor thereby defining a gap therebetween, moving the vertical movable cutting device down through the gap between the first and second conveyors while simultaneously and in a coordinated fashion moving portions of the first and second conveyors so as to move the gap contrary to the conveyance direction thereby transferring the clay column horizontally from the first to the second conveyor across the gap so that the cutting device effectively moves contrary to the direction of the conveyance of and through the clay column thereby cutting the clay column, and transporting the cut clay column away from the second conveyor.

7. The method of claim 6 wherein the first and second conveyors have variable length supporting surfaces and the transfer of the clay columns from the first to the second conveyor is accomplished by simultaneously shortening the supporting surface of the first conveyor and lengthening the supporting surface of the second conveyor.

8. The method as in claim 6 further including the step of driving the first conveyor in the conveyance direction during cutting at a predetermined speed to assure continued movement of the clay column in the conveyance direction.

9. Apparatus for transversely cutting elongated clay columns into a plurality of shorter sections, said apparatus comprising:

a transport system including first and second supports spaced apart to define an opening therebetween, means for causing relative movement between a clay column and said opening such that the opening passes beneath the column, cutting means positioned within the opening and synchronously movable therein between first and second positions for cutting the column in a single pass as the column moves with respect to the opening.

10. Apparatus as in claim 9 and further comprising means for simultaneously cleaning said cutting means as it is being moved through said opening.

11. A device for cutting bricks from a clay column comprising:

means for moving the clay column in a machine direction including first and second supports, said second support positioned downstream from the first so as to define a gap therebetween, means for mounting at least one cutting wire at an angle with respect to the plane defined by the supporting surface of the supports, means for moving said at least one cutting wire within said gap between a raised position where the cutting portion of said at least one cutting wire is above the clay column and a lowered position where the cutting portion of said at least one cutting wire is below the clay column, and moving means for moving said column from the first to the second support in a coordinated fashion with movement of said at least one cutting wire so that as said at least one cutting wire moves downwardly it passes through said clay column.

12. A device for cutting brick blanks from clay columns comprising:

first and second support assemblies each having a width that will completely support the full length of the clay column, the second support assembly being located downstream from the first by a predetermined distance and defining gap therebetween, means for moving the clay column from the first to the second support assembly, means for mounting at least one cutting wire in a plane at an angle with the plane defined by the supporting surface of the first and second support assemblies, and means for synchronously moving said cutting wire within said gap between a first raised position and second lowered position so that when the column is moved from the first to the second support assembly, and said at least one cutting wire is moved from tis raised to its lowered position, said at least one cutting wire will penetrate and pass through the clay column as the clay column is transferred from the first to the second support assembly.

13. A device for cutting bricks from a clay column comprising:

first and second conveyor assemblies for respectively receiving and discharging the clay column and for moving the clay column in a conveying direction with the second conveyor assembly being positioned downstream from the first conveyor assembly;

each of said conveyor assemblies including a conveyor belt and at least two rollers for supporting said belt and for defining the supporting surface thereof;

said first and second conveyor assemblies being spaced apart a predetermined distance so as to define a gap therebetween;

each of said first and second conveyor assemblies including driving means for driving the conveyor belts;

means for mounting at least one cutting wire in a vertical plane and at an acute angle with respect to the plane defined by the supporting surface of the conveyor belts;

means for moving said at least one cutting wire vertically within said gap between a raised position above the clay column and a lowered position where a substantial portion of said at least one cutting wire lies below said supporting surface;

means for jointly moving at least the rollers in each of said first and second conveyor assemblies positioned on opposite sides of said gap; and moving means for moving said means for jointly moving, in a horizontal direction counter to the conveying direction, in a coordinated fashion with movement of said at least one cutting wire so as to follow the point of intersection of said at least one cutting wire with the plane defined by the surface of said conveyor belts so that, as said at least one cutting wire is moved downwardly, said at least one cutting wire passes through a clay column positioned on siad first conveyor assembly and the gap between said first and second conveyor assemblies will move horizontally in a direction counter to the machine direction so as to pass beneath that clay column thereby simultaneously cutting the clay column and transferring the clay column from the first to the second clay conveyor assembly.

14. A device as in claim 13 wherein the total length of said conveyor belts remains constant, and wherein the rollers positioned away from the gap are held in a fixed location and the rollers on each side of said gap are mounted so as to be horizontally movable so that the length of the supporting surfaces on the first and second conveyor assemblies are proportionally variable when said moving means is moving said jointly moving means and wherein each of said conveyor assemblies further include a tension compensation roller to compensate for changes in the length and the supporting surface.

15. A device as in claim 13 wherein one of said conveyor assemblies includes rollers having a fixed distance between their axes thereby defining a fixed length supporting surface, the other conveyor assembly having the roller positioned away from the gap held in a fixed location and the roller adjacent the gap being mounted so as to be horizontally movable so that the length of the supporting surface of the other conveyor is variable when said moving means moves said jointly moving means.

16. A device as in claim 15 wherein said one conveyor assembly is included within said second conveyor assembly and said other conveyor assembly is included within said first conveyor assembly.

17. A device as in claim 15 wherein the conveyor assembly having a fixed supporting surface in the conveying direction is dirven during cutting so that during cutting the speed of the conveyor belt is equal to the speed of movement effected by said moving means in the opposite direction.

18. A device as in claim 13 wherein the rollers in each of the first and second conveyor assemblies are spaced apart a fixed distance and the conveyor belt in each conveyor assembly is driven at a speed in the conveying direction during cutting equal to the speed of movement effected by said moving means in the opposite direction.

19. A device as in claim 13 wherein the said means for jointly moving includes adjusting means to vary the size of said gap.

20. A device as in the claim 13 including wire cleaning means movably attached to said jointly moving means so as to extend into said gap for cleaning said at least one cutting wire as said at least one cutting wire moves with respect to said gap.

21. A device for cutting brick blanks from clay columns comprising:

first and second conveyor assemblies each having a width that will completely support the full length of the clay column, said second conveyor assembly being located downstream from the first, each of said first and second conveyor assemblies including an undriven end roller, means for mounting each of the undriven end rollers a fixed distance from one another so as to define a gap therebetween and for moving the rollers in a joint manner horizontally thereby simultaneiously altering relative position of the gap, means for mounting at least one cutting wire in a vertical plane and at an acute angle with the plane defined by the supporting surfaces of the first and second conveyor assemblies, means for synchronously moving said cutting wire mounting means vertically within the gap between a raised position to a lowered position with the gap following the point of intersection of said at least one cutting wire with said plane so that, when the conveyor belts are stopped and the undriven end rollers are moved toward the receiving side of the apparatus and said at least one cutting wire is moved from its raised to is lowered position, said at least one cutting wire will penetrate and pass through the clay column as the clay column is transferred from the first to the second conveyor assembly.

22. A device as in claim 21 wherein each of the conveyor assemblies also includes:

a constant length conveyor belt, a fixed roller which together with the horizontally movable undriven end roller provides support for the supporting surface of the conveyor belt, and a tension compensating roller so that, as the distance between the horizontally movable undriven end roller and the fixed roller is varied, the change in belt length is compensated for by the tension roller.

23. A method of cutting brick blanks from clay columns while on a conveying system including two spaced apart supports with a movable cutting device positioned at an angle to the plane defined by the surface of the supports comprising the steps of:

sequentially transporting clay columns onto a first support positioned a predetermined distance from a downstream second support, and moving the cutting device between the first and second supports at an angle to the support surface while simultaneously transferring the clay column from the first to the second support across the space therebetween so that the cutting device engages and continuously moves through and cuts the clay column into brick blanks in a single stroke during transfer of the column from the first to the second support.

* * * * *